US011084313B2

(12) United States Patent
Nejad et al.

(10) Patent No.: US 11,084,313 B2
(45) Date of Patent: Aug. 10, 2021

(54) POP-UP GIFT CARD WITH REMOVABLE POP-UP DISPLAY STRUCTURE

(71) Applicant: LovePop, Inc., Boston, MA (US)

(72) Inventors: Dariush S. Nejad, Somerville, MA (US); Jozef Karpiel, Cambridge, MA (US); Robin S. Rose, Cambridge, MA (US); Emilio Latorre Armendariz, Arlington, MA (US); John P. Wise, Cambridge, MA (US)

(73) Assignee: LOVEPOP, INC., Boston, MA (US)

( * ) Notice: Subject to any disclaimer, the term of this patent is extended or adjusted under 35 U.S.C. 154(b) by 0 days.

(21) Appl. No.: 16/561,294

(22) Filed: Sep. 5, 2019

(65) Prior Publication Data

US 2020/0070562 A1 Mar. 5, 2020

Related U.S. Application Data

(60) Provisional application No. 62/727,351, filed on Sep. 5, 2018.

(51) Int. Cl.

| | |
|---|---|
| ***G09F 1/06*** | (2006.01) |
| ***B42D 15/04*** | (2006.01) |
| *G09F 1/08* | (2006.01) |

(52) U.S. Cl.

CPC ..... *B42D 15/042* (2013.01); *G09F 1/06* (2013.01); *G09F 1/065* (2013.01); *G09F 1/08* (2013.01)

(58) Field of Classification Search

CPC ..... G09F 1/06; G09F 1/065; G09F 1/08

USPC ..... 40/124.08

See application file for complete search history.

(56) References Cited

U.S. PATENT DOCUMENTS

| | | | | |
|---|---|---|---|---|
| 2,148,279 | A * | 2/1939 | Sandberg | G09F 1/04 40/124.08 |
| 4,084,015 | A * | 4/1978 | Patterson | B42D 15/042 229/116.1 |
| 4,234,148 | A * | 11/1980 | Maddestra | A47G 1/142 248/174 |
| 9,842,516 | B2 * | 12/2017 | Yeh | B44C 5/06 |
| 2003/0097773 | A1 * | 5/2003 | Oh | G09F 1/06 40/124.08 |
| 2005/0132621 | A1 * | 6/2005 | Bostick, II | G09F 1/06 40/124.08 |
| 2005/0278994 | A1 * | 12/2005 | Evans, Jr. | G09F 1/06 40/124.17 |
| 2007/0293118 | A1 * | 12/2007 | Prescott | B42D 15/042 446/148 |

(Continued)

*Primary Examiner* — Kristina N Junge
(74) *Attorney, Agent, or Firm* — Polsinelli PC

(57) ABSTRACT

A pop-up gift card includes a card that is foldable along a fold line between closed and opened positions. The card includes a separable perforated section extending over both sides of the fold line. An erectable pop-up display structure comprising a plurality of intersecting slice-form elements is mounted on the perforated section of the card. When the card is closed, the pop-up display structure is in a flattened state, and when the card is opened, the pop-up display structure is in an erected 3-D state. The pop-up display structure can be removed from the card by separating the perforated section from the rest of the card. A support element can be affixed to the perforated section for maintaining the pop-up display structure in the 3-D state when the pop-up display structure is removed from the card.

20 Claims, 7 Drawing Sheets

(56) References Cited

U.S. PATENT DOCUMENTS

| | | | | |
|---|---|---|---|---|
| 2010/0018090 | A1* | 1/2010 | Dickert | B42D 5/027 40/124.08 |
| 2010/0325924 | A1* | 12/2010 | Aletto | B42D 15/045 40/124.03 |
| 2014/0360065 | A1* | 12/2014 | Barber | B42D 15/042 40/124.14 |
| 2015/0332611 | A1* | 11/2015 | Yeh | B44C 5/00 40/124.08 |
| 2016/0365009 | A1* | 12/2016 | Wise | G09F 1/06 |

* cited by examiner

POP-UP GIFT CARD WITH REMOVABLE POP-UP DISPLAY STRUCTURE

CROSS REFERENCE TO RELATED APPLICATION

This application claims priority from U.S. Provisional Patent Application No. 62/727,351 filed on Sep. 5, 2018 entitled POP-UP GIFT CARD WITH REMOVABLE POP-UP DISPLAY STRUCTURE, which is hereby incorporated by reference.

BACKGROUND

The present application relates generally to pop-up cards and, more particularly, to a pop-up gift card with a removable pop-up display structure usable as a display item.

BRIEF SUMMARY OF THE DISCLOSURE

A pop-up card in accordance with one or more embodiments includes a card that is foldable along a fold line between closed and opened positions. The card includes a separable perforated section extending over both sides of the fold line. An erectable pop-up display structure comprising a plurality of intersecting slice-form elements is mounted on the perforated section of the card. When the card is closed, the pop-up display structure is in a flattened state, and when the card is opened, the pop-up display structure is in an erected 3-D state. The pop-up display structure can be removed from the card by separating the perforated section from the rest of the card. A support element can be affixed to the perforated section for maintaining the pop-up display structure in the 3-D state when the pop-up display structure is removed from the card.

In accordance with one or more further embodiments, a method is disclosed for assembling a display item from a pop-up card. The pop-up card comprises a card foldable along a fold line between closed and opened positions. The card includes a separable perforated section extending over both sides of the fold line. The pop-up card further includes an erectable pop-up display structure comprising a plurality of intersecting slice-form elements mounted on the perforated section of the card such that when the card is closed, the pop-up display structure is in a flattened state, and when the card is opened, the pop-up display structure is in an erected 3-D state. The method includes the steps of (a) removing the pop-up display structure from the card by separating the perforated section from the rest of the card, and (b) affixing a support element to the perforated section for maintaining the pop-up display structure in the 3-D state.

BRIEF DESCRIPTION OF THE DRAWINGS

Like or identical reference numbers are used to identify common or similar elements.

DETAILED DESCRIPTION

Pop-up cards are greeting cards that include an erectable pop-up display structure that unfolds from a flattened state when the card is closed to an erected 3-D state when the card is opened.

Various embodiments disclosed herein relate to a pop-up gift card with a removable pop-up display structure usable as a display item.

Figure 1:
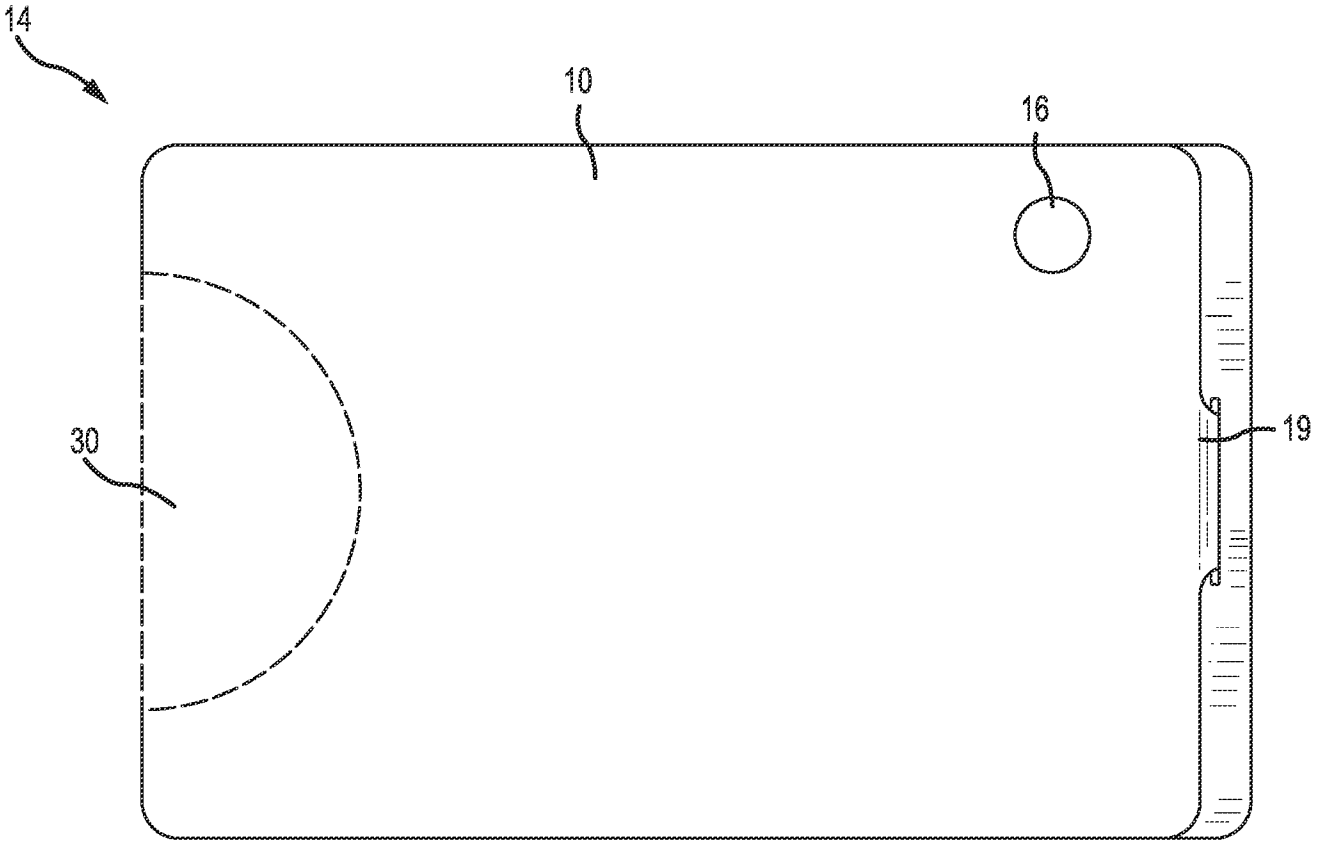
FIGS. 1 and 2 illustrate opposite sides of a pop-up gift card in a folded configuration in accordance with one or more embodiments.
Figure 2:
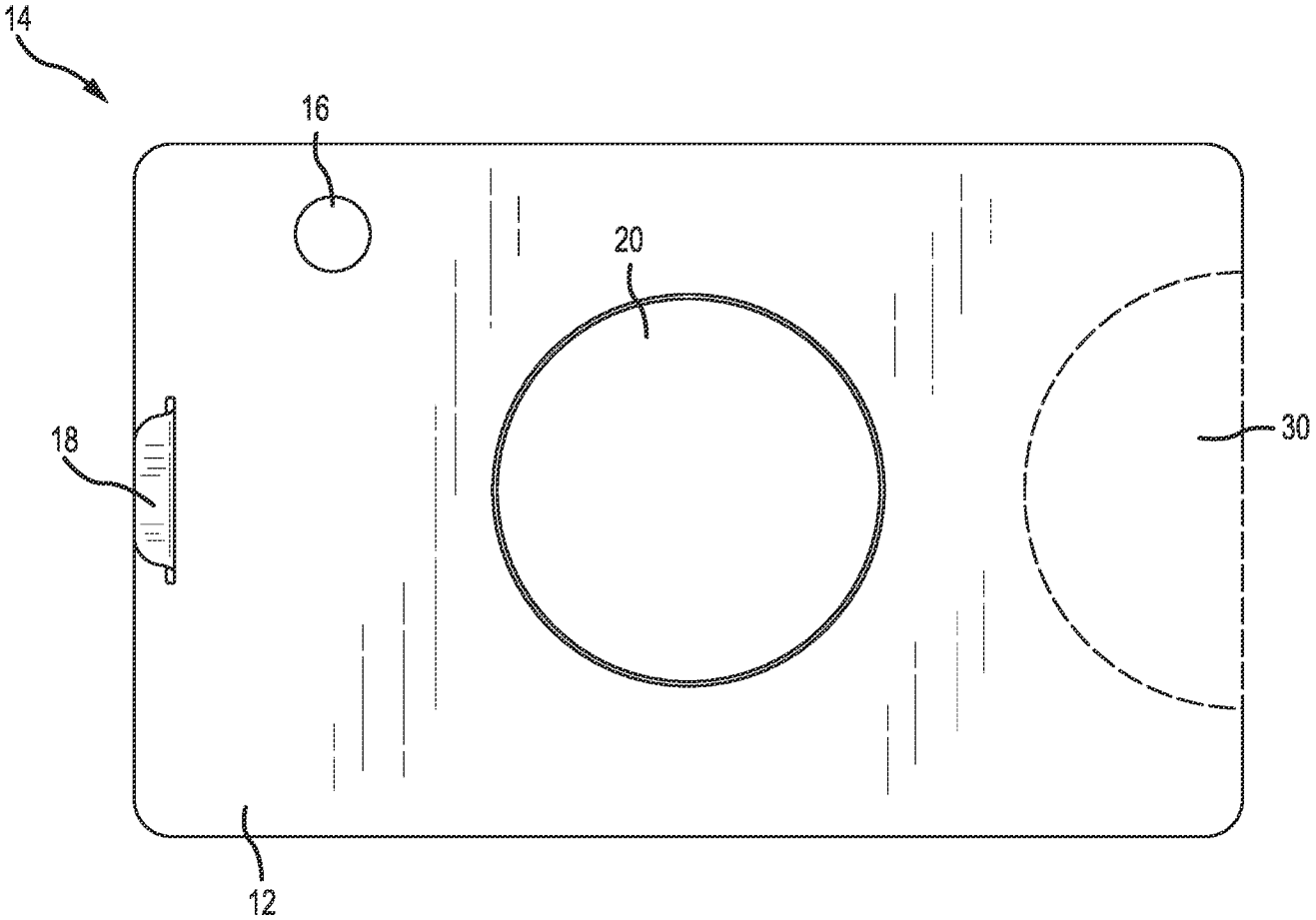

FIGS. 1 and 2 illustrate opposite sides 10, 12 of a pop-up gift card 14 in a folded configuration in accordance with one or more embodiments.

The gift card 14 includes an opening 16 at a corner thereof usable for tying the card 14 to a gift or other item using ribbons, strings, and the like.

The gift card 14 also includes a tab 18 on one side and a corresponding slot 19 on the other for receiving the tab 18 to keep the card 14 closed in the folded configuration.

A support element 20 used for supporting the pop-up display structure when removed is removably attached to one side of the gift card 14.

Figure 3:
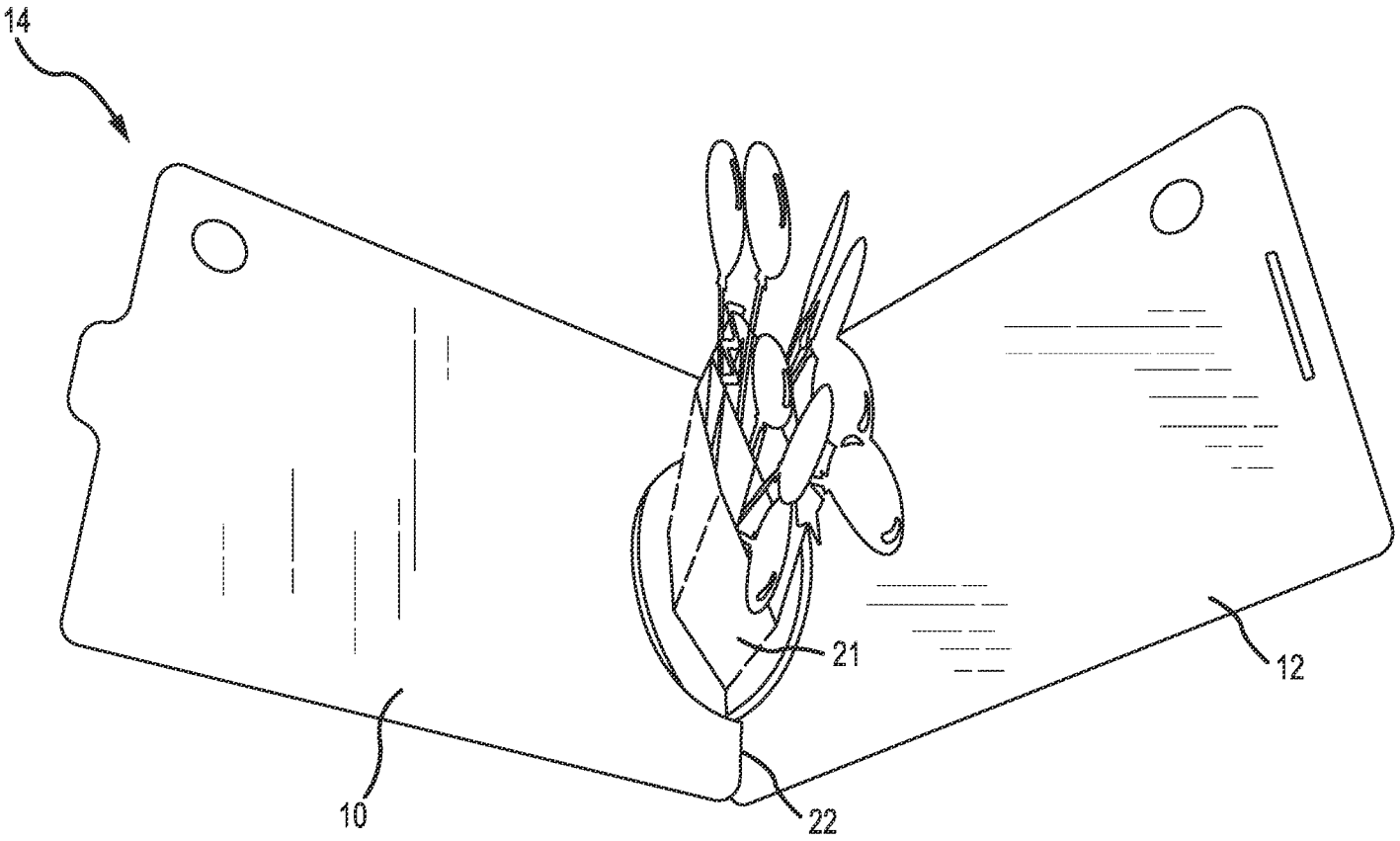
FIGS. 3 and 4 illustrate the pop-up gift card being opened.
Figure 4:
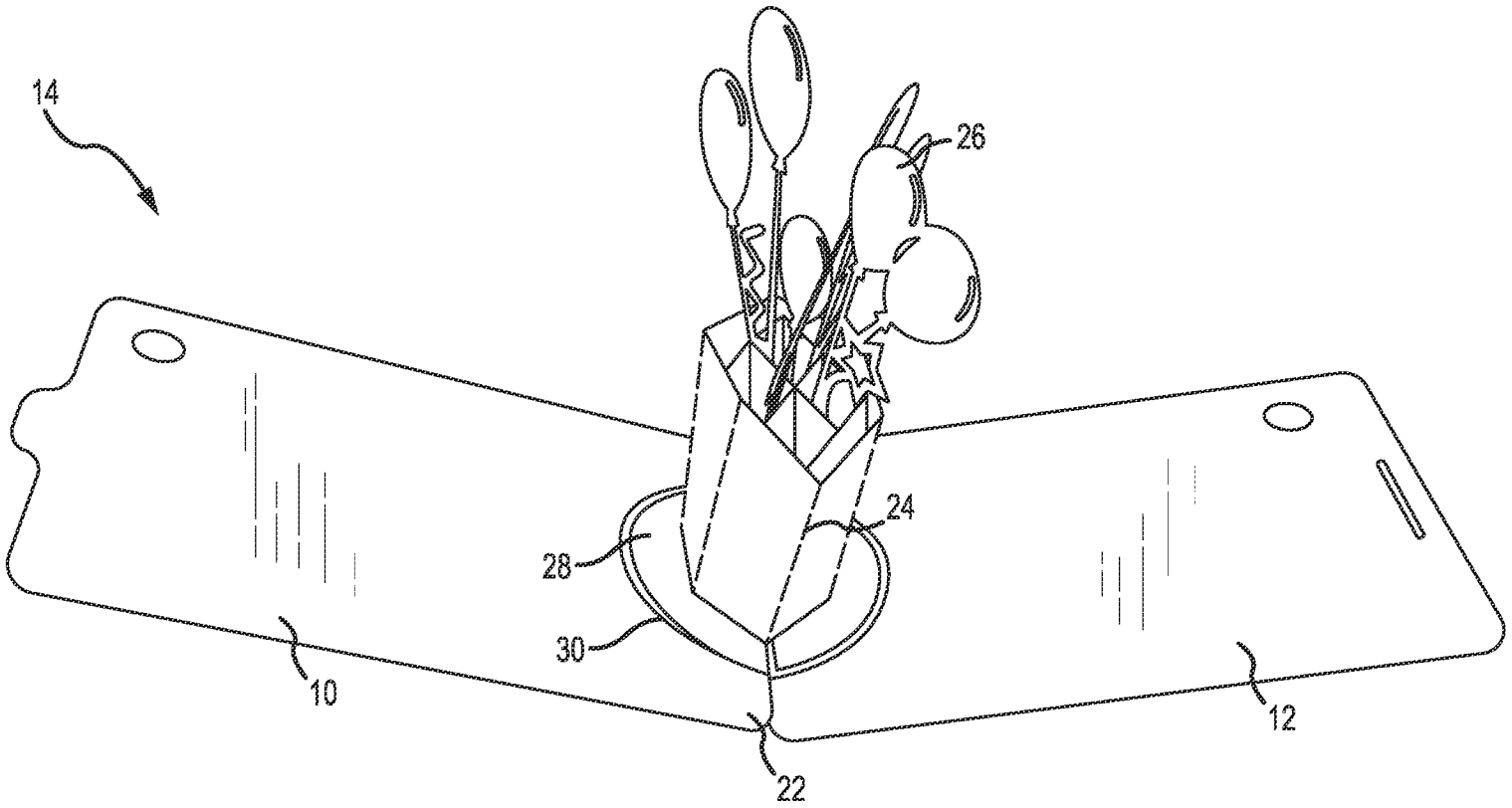

FIGS. 3 and 4 illustrate the pop-up gift card 14 being opened. As shown in FIG. 4, the pop-up card 14 comprises a card foldable along a fold line 22 between closed and opened positions and an erectable pop-up display structure 24 on the card. The pop-up display structure 24 comprises a plurality of intersecting slice-form elements 26 on a base 28. When the card 14 is closed, the pop-up display structure 24 is in a flattened state, and when the card 14 is opened, the pop-up display structure 24 is in an erected 3-D state. U.S. Pat. No. 9,524,658, which is incorporated by reference herein, illustrates various examples of pop-up cards and the construction of pop-up display structures from slice-form elements.

The card 14 includes a separable perforated section 30 extending over both sides of the fold line 22 of the card 14. The base 28 of the pop-up display structure 24 is attached to one side of the perforated section 30.

Figure 5:
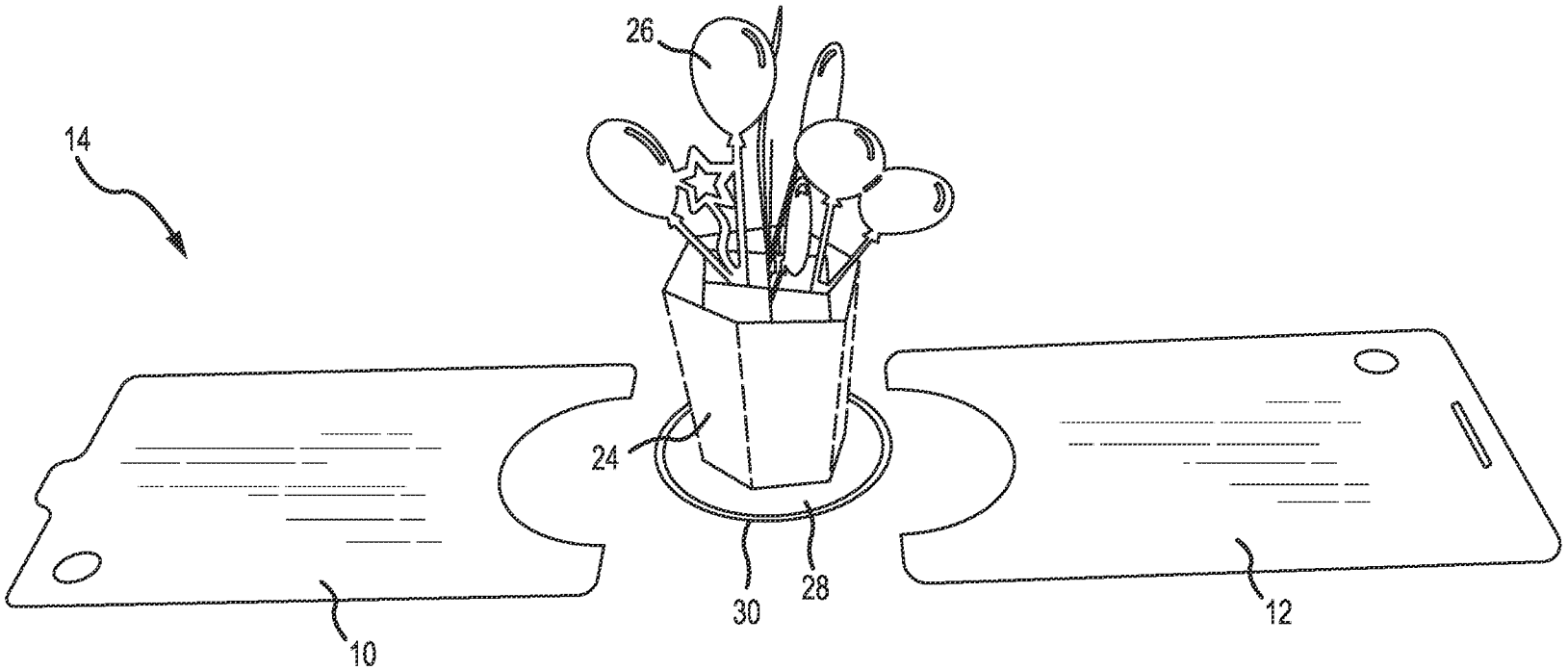
FIG. 5 illustrates separation of the pop-up display structure from the card in accordance with one or more embodiments.

As shown in FIG. 5, the pop-up display structure 24 can be removed from the card 14 by separating the perforated section 30 from the rest of the card 14 along the defining perforation.

Figure 6:
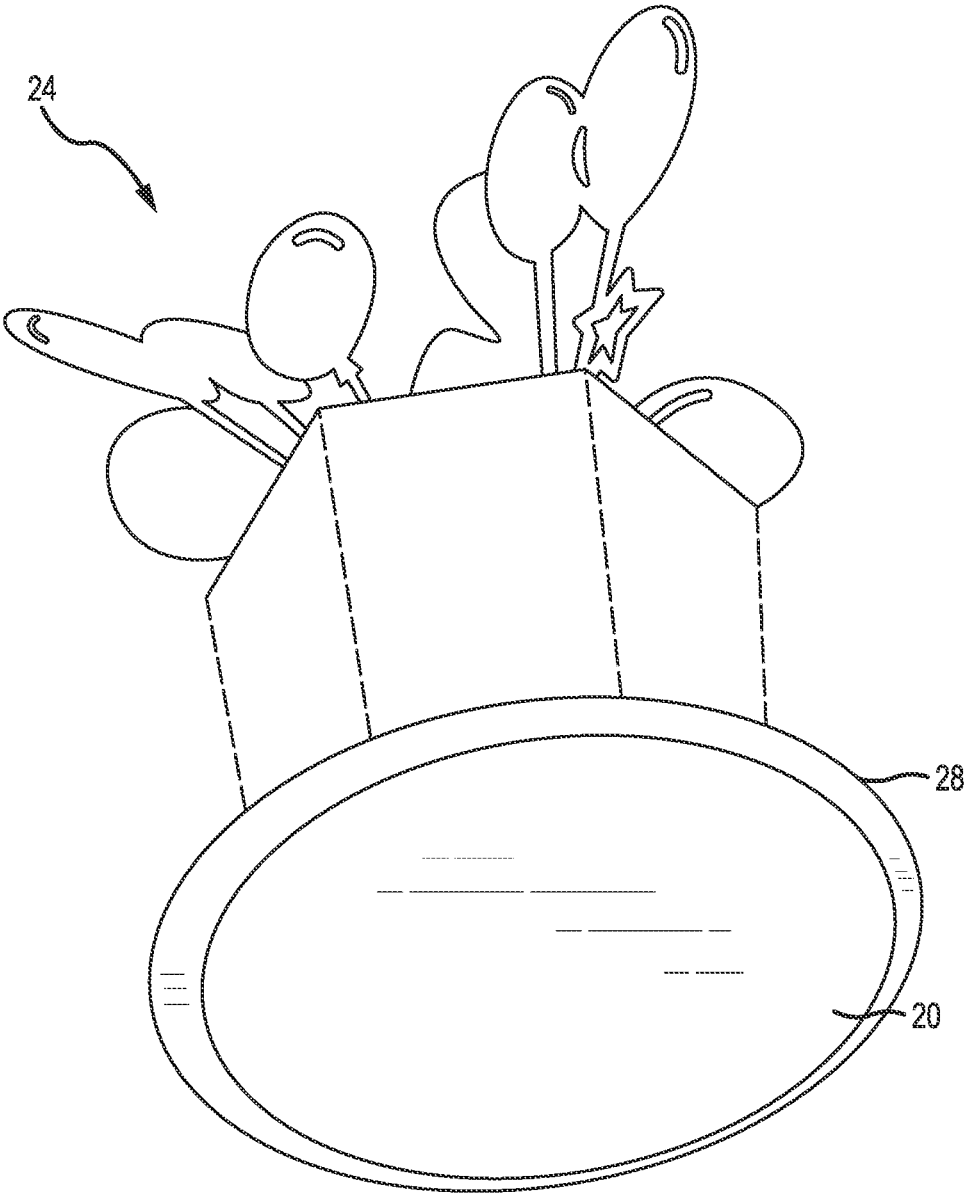
FIG. 6 illustrates affixing a support element to the pop-up display structure.

As shown in FIG. 6, the support element 20 can be removed from the card and affixed to the underside of the base 28 of the pop-up display structure 24 to maintain the pop-up display structure 24 in the 3-D state. The support element 20 can be a rigid disk made from a variety of materials including, e.g., card stock, plastic, metal, or wood. The shape of the support element 20 preferably conforms to the shape of the base 28 of the pop-up display structure 24. In this example, the support element 20 comprises a round plastic disk.

In one or more embodiments, the support element 20 is removably bonded to the outside of the card 14 with an adhesive that can be used to secure the support element 20 to the bottom of the pop-up display structure 24.

Figure 7:
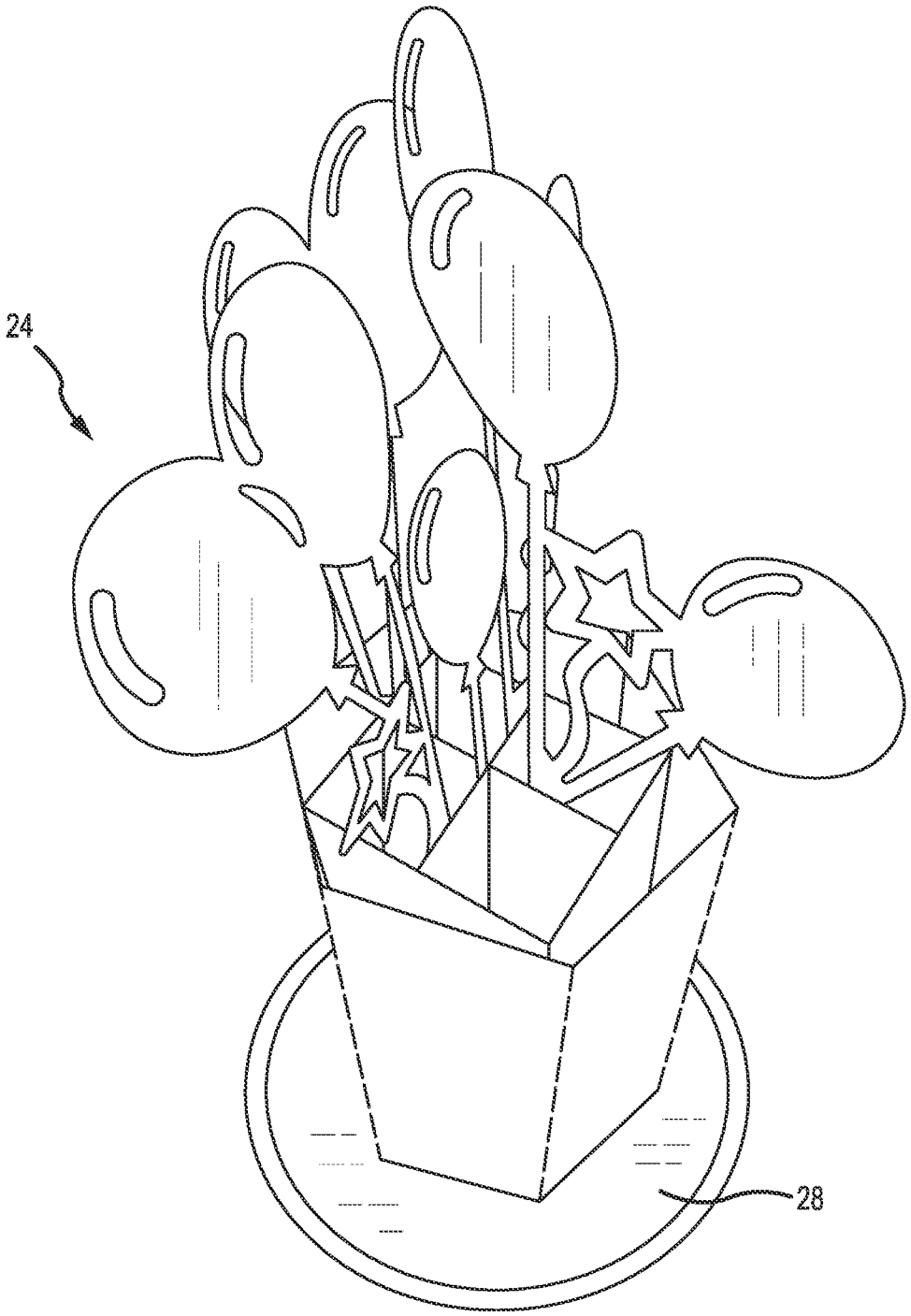
FIG. 7 illustrates the pop-up display structure with attached support element used as a display item.

Thereafter, the pop-up display structure 24 can be used as a display item as shown in FIG. 7. The support element 20 both supports the pop-up display structure 24 on a surface as well as maintains the pop-up display structure 24 in the 3-D state.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments.

Additionally, elements and components described herein may be further divided into additional components or joined together to form fewer components for performing the same functions.

Accordingly, the foregoing description and attached drawings are by way of example only, and are not intended to be limiting.

The invention claimed is:

1. A pop-up card, comprising:

a card foldable along a fold line between a closed position and an opened position, the fold line of the card defining a first side and a second side an erectable pop-up display structure comprising a plurality of intersecting slice-form elements on a base, the erectable pop-up display structure including a display fold line aligned with the fold line of the card, the erectable pop-up display structure foldable along the display fold line between a flattened state and an erected state, the erectable pop-up display structure in the flattened state when the card is in the closed position, the erectable pop-up display structure in the erected state when the card is in the opened position;

a perforated section extending about the base of the erectable pop-up display structure over the fold line onto both the first side and the second side of the card, the erectable pop-up display structure being removable from the card by separating the perforated section from the first side and the second side; and a support element configured to maintain the erectable pop-up display structure in the erected state when the erectable pop-up display structure is removed from the card.

2. The pop-up card of claim 1, wherein the support element is removably bonded to a surface of the card.

3. The pop-up card of claim 2, wherein the support element is removable from the surface for affixing to the perforated section to maintain the erectable pop-up display structure in the erected state.

4. The pop-up card of claim 1, wherein the support element comprises a rigid disk.

5. The pop-up card of claim 1, wherein the support element comprises card stock, plastic, metal, or wood.

6. The pop-up card of claim 1, wherein the card and the erectable pop-up display structure comprise card stock.

7. The pop-up card of claim 1, wherein the card includes an opening at a corner, the opening configured for receiving a string for tying the pop-up card to an object.

8. The pop-up card of claim 1, wherein the card includes a tab on the first side and a slot on the second side of the card, the tab receivable in the slot to hold the card in the closed position.

9. The pop-up card of claim 1, wherein the perforated section is separatable from the first side and the second side when the erectable pop-up display structure is in the erected state.

10. The pop-up card of claim 1, wherein the base is attached to a surface of the perforated section.

11. A method comprising:

moving a card about a fold line from a closed position to an opened position, the fold line of the card defining a first side and a second side, the fold line of the card aligned with a display fold line of an erectable pop-up display structure comprising a plurality of intersecting slice-form elements on a base, the erectable pop-up display structure moving about the display fold line from a flattened state to an erected state as the card moves from the closed position to the opened position;

removing the erectable pop-up display structure from the card by separating the perforated section from the first side and the second side of the card, the perforated section extending about the base of the erectable pop-up display structure over the fold line onto both the first side and the second side of the card; and affixing a support element to the perforated section following removal of the erectable pop-up display structure from the card, the support element maintaining the erectable pop-up display structure in the erected state.

12. The method of claim 11, wherein the support element is removably bonded to a an outside surface of the card.

13. The method of claim 12, further comprising:

removing the support element from the surface of the card for affixing to the perforated section.

14. The method of claim 13, wherein the support element is removed from the surface of the card by peeling.

15. The method of claim 11, wherein the support element comprises a rigid disk.

16. The method of claim 11, wherein the support element comprises card stock, plastic, metal, or wood.

17. The method of claim 11, wherein the card and the erectable pop-up display structure comprise card stock.

18. The method of claim 11, wherein the perforated section is separated from the first side and the second side when the erectable pop-up display structure is in the erected state.

19. The method of claim 11, further comprising:

inserting a string through an opening in the card; and tying the string to an object.

20. The method of claim 11, further comprising:

inserting a tab on the first side of the card into a slot on the second side of the card when the card is in the closed position.

* * * * *